US012623275B2

(12) United States Patent
Ahlemeyer et al.

(10) Patent No.: US 12,623,275 B2
(45) Date of Patent: May 12, 2026

(54) SUPPLY DEVICE FOR JOINING ELEMENTS, SETTING TOOL WITH THE SUPPLY DEVICE AND ASSOCIATED SUPPLY AND SETTING METHOD

(71) Applicant: Böllhoff Verbindungstechnik GmbH, Bielefeld (DE)

(72) Inventors: Fabian Ahlemeyer, Gütersloh (DE); Bernd Haesler, Halle (DE); Kilian Doedtmann, Bramsche (DE); Benjamin Roeschert, Schlangen (DE); Oliver Schienstock, Delbrück (DE)

(73) Assignee: BÖLLHOFF VERBINDUNGSTECHNIK GMBH, Bielefeld (DE)

( * ) Notice: Subject to any disclaimer, the term of this patent is extended or adjusted under 35 U.S.C. 154(b) by 0 days.

(21) Appl. No.: 19/304,055

(22) Filed: Aug. 19, 2025

(65) Prior Publication Data

US 2026/0054311 A1 Feb. 26, 2026

(30) Foreign Application Priority Data

Aug. 20, 2024 (EP) ..... 24195296
Oct. 24, 2024 (EP) ..... 24208633

(51) Int. Cl.
*B21J 15/30* (2006.01)

(52) U.S. Cl.
CPC ..... *B21J 15/30* (2013.01)

(58) Field of Classification Search
CPC ..... B21J 15/30
See application file for complete search history.

(56) References Cited

U.S. PATENT DOCUMENTS 4,969,582 A 11/1990 Gauger
7,331,098 B2 2/2008 Matthews et al.
(Continued)

FOREIGN PATENT DOCUMENTS

DE 3739944 C1 3/1989
DE 4400350 A1 7/1995
DE 102018123215 A1 3/2020
(Continued)

OTHER PUBLICATIONS

Extended European Search Report, with English translation, issued in corresponding European Patent Application No. 24208633.8 on Apr. 11, 2025, 10 pages.

*Primary Examiner* — Moshe Wilensky
(74) *Attorney, Agent, or Firm* — MH2 Technology Law Group, LLP

(57) ABSTRACT

A supply device for joining elements. The supply device includes a receiving portion for at least one joining element, in which a joining element is receivable and positionable in front of a first opening, a circumferentially closed hose of a flexible material which on a first end is connected with the receiving portion and on an opposite, second end with a discharge portion, as well as a flexible thrust element which is movable back and forth using a drive means through the hose between a retracted position in which a front end of the thrust element is located in the receiving portion and an extended position in which the front end is located in the discharge portion, so that the joining element which is positioned in front of the first opening is pushable with the thrust element out of the receiving portion through the hose into the discharge portion.

17 Claims, 8 Drawing Sheets

(56) References Cited

U.S. PATENT DOCUMENTS

Figure 1:
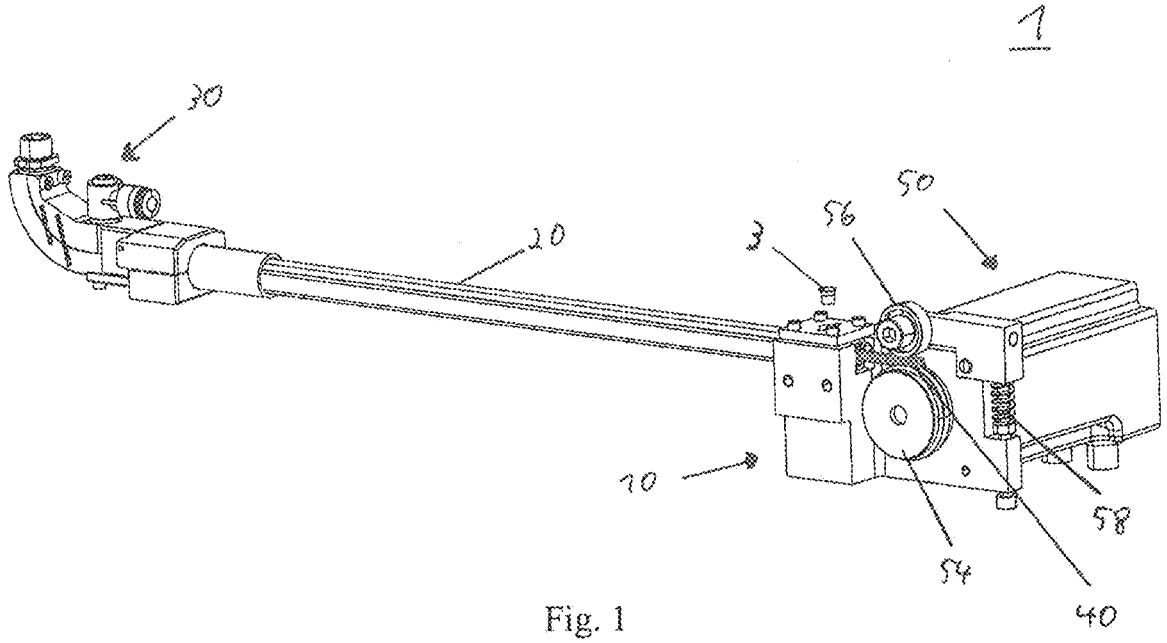

| | | | |
|---|---|---|---|
| 8,690,037 | B2 | 4/2014 | Wenzel et al. |
| 2007/0289354 | A1 | 12/2007 | Reiter |

FOREIGN PATENT DOCUMENTS

| | | | |
|---|---|---|---|
| EP | 1297917 | A2 | 4/2003 |
| EP | 4129592 | A1 | 2/2023 |
| GB | 2285405 | A | 7/1995 |
| WO | 2006084847 | A1 | 8/2006 |
| WO | 2010043362 | A2 | 4/2010 |
| WO | 2010139514 | A1 | 12/2010 |
| WO | 2011029817 | A2 | 3/2011 |
| WO | 2019110990 | A2 | 6/2019 |

SUPPLY DEVICE FOR JOINING ELEMENTS, SETTING TOOL WITH THE SUPPLY DEVICE AND ASSOCIATED SUPPLY AND SETTING METHOD

CROSS REFERENCE TO RELATED APPLICATIONS

This patent application claims the benefit and priority of European Patent Application No. 24208633.8, filed with the European Patent Office on 24 Oct. 2024. This patent application also claims the benefit and priority of European Patent Application No. 24195296.9, filed with the European Patent Office on 20 Aug. 2024. The disclosures of both applications are hereby incorporated by reference in their entireties as part of the present application.

FIELD OF THE INVENTION

The present invention is related to a supply device for joining elements, a setting tool with the supply device as well as a supply method by using the supply device.

BACKGROUND OF THE INVENTION

Devices and methods for setting joining elements such as rivets, are generally known to the skilled person. Usually, with such a device, a setting tool is mounted on a C-frame as supporting structure. The C-frame can be fastened to a robot arm, so that numerous automatic processes can be carried out by the robot at the necessary locations.

In the runup to the setting step, the joining elements must be transported from a joining element source to a position under the punch in the setting head of the setting tool. Typically, this takes place by means of a flexible profile hose. Thus, the joining elements can be supplied to the setting tool by means of compressed air and/or gravity.

Here, the supply of the joining elements takes place individually or in groups and requires one or more handling mechanisms along the supply, so that only the one or the necessary joining elements are supplied as needed.

In this regard, it is for example known from WO 2006/084847 A1 to provide connecting elements in rows in the same alignment and to transport same through a conveying channel to a loading device arranged on the manufacturing device directly adjacent to a processing position of the joining element under the punch. Conveyance of the connecting elements proceeds in individual steps of conveyance, at different time intervals. During every step of conveyance, a column from a plurality of connecting elements that rest one against the other with their parallel limiting surfaces aligned in the same direction is conveyed from the feeding device to the loading device on the manufacturing device by passing air into the conveying channel. The conveyance from the loading device to the processing position under the punch takes place via a rigid loading slide which is movable back and forth in a loading channel by means of a pneumatically driven piston.

A similar solution is known from WO 2010/139514 A1. Here, a singulation slide for a device for feeding a connecting element is described. The singulation slide includes a through hole extending in an axial direction for receiving the connecting element. The through hole is formed of at least two leg segment. The singulation slide is furthermore configured as one piece and comprises a basic segment. A transition from the basic segment to each of the leg segments is configured to provide an elasticity of the corresponding leg segment in radial direction. Furthermore, a device for supplying a connecting element into a processing position and a method are described.

In this context, the skilled person also knows solutions where the correct positioning of the joining element in the processing position takes place by means of a flexible plunger, which is arranged in its own channel. For example, DE 44 00 350 A1 describes a bolt welding device having a bolt retainer with a bolt feeding and positioning device which can be connected to a welding force source, and having an adjusting device by means of which the bolt retainer is movable towards a workpiece and away from it. The control device is made of a primary part which in use is securely mounted to a rack and a secondary part which is linearly movable with respect to the primary part, the secondary part carrying, by means of an electrically isolating connecting part, the bolt feeding and positioning device to which the bolt retainer is fastened. In the adjustment path of the bolt feeding and positioning device and the bolt retainer, a plunger interacting with the bolt feeding and positioning device is arranged in a manner fixed to a rack. Such a plunger can be flexible and enter through an angular lateral passage.

In order to create a device for feeding elongated fastening means to a fastening device, with the fastening means being fed individually through a first channel and pushed into a collet chuck by a plunger that is guided in a further, second channel, with which device a proper and undisrupted supply to the retaining means is guaranteed even during the supply of short fastening means, DE 37 39 944 C1 suggests that the first channel extends linearly through the device up to the retaining means that is arranged coaxially to same, that the second channel opens in an acute angle into the first channel, and that the plunger is configured to be flexible. In one end position, the plunger is arranged outside of the first channel and in the advanced bolt feeding position, which corresponds to the second end position, it is partly arranged in the second and partly arranged in the first channel.

Besides these systems with which a supply takes place by means of a rigid piston or a flexible plunger, systems are known with which the supply takes place by means of compressed air, only.

An example of such a system can be found in EP 4 129 592 A1. The feeding device described there for feeding nails to a nail setting device comprises a hose pipe with a front connection for the attachment to a nail setting device and at least a rear connection for the attachment to a provisioning unit for nails. By means of the hose pipe, nails can be fed one after the other in their longitudinal direction to the nail setting device. Furthermore, a nail setting device is described, in particular a pneumatic nailer as well as an arrangement comprising a nail setting device and a feeding device.

A fastening element supply device for automatically selecting and supplying fastening elements, e.g. rivets, to a setting tool is also described in EP 1 297 917 A2. The fastening elements are preloaded in a packaging and are discharged via at least one fastening element supply tube which connects the setting device with a fastening element supply device. The fastening element supply device releases selected fastening elements from the packing into the discharge tube. In the tube, the connecting elements are transportable individually or in groups from the supply device to the tool. A transition station that is attached to the tool or the supply tube transmits a fastening element from the supply device into the tool. The transition station is movable between a first position, in which an exit of the transition station is located next to the tool so that a supplied fastening element can be inserted by the transition station into the tool, and a second position, in which it is remote from the tool so as to allow the tool or a part of same to move in the direction of a work piece in order to insert a loaded fastening element. The supply tube is provided with wear-resistant elements.

Finally, the skilled person knows devices which instead of compressed air use mechanical elements for feeding the joining elements. This does, for example, serve to avoid the disadvantages associated with the flexible profile hoses which are necessary when using compressed air for feeding the joining elements.

WO 2019/110990 A2 for example describes a rivet supply system for feeding rivets to a rivet setting tool comprising a punch, an extendable nose arrangement and a die. The rivet supply system comprises at least a rivet supply rail for supplying the rivets to the nose arrangement, at least a rivet transfer device for retaining or releasing the rivets that is received in the rivet receiving zone and at least a refillable magazine for storing the rivets close to the setting tool. The magazine comprises at least one magazine section of the rivet feeding rail. The rivets can be stored in the magazine or transported through the magazine to be supplied to the setting tool. Moreover, the magazine comprises at least one connection interface for refilling the magazine, e.g. from a mass supply. The magazine is in a rivet supply relationship with the nose arrangement so that it can supply rivets as needed to the setting tool, and is movable along with the nose arrangement. Thus, no long flexible supply hoses are necessary anymore for supplying the rivets from the magazine to the setting device and the supply can be guaranteed continuously.

A magazine of a setting device for storing and supplying a plurality of joining elements, in particular setting bolts, a provisioning module for joining elements and a setting tool in combination with these elements is described in WO 2010/043362 A2. The magazine comprises a basic element within the setting device with a storage groove in which the joining elements are aligned and receivable jointly movably and the one end of which opens into a head piece of the setting device. Furthermore, an advancing mechanism is provided with which the joining elements are movable within the storage groove towards the head piece of the setting tool. Finally, the magazine comprises a discharge mechanism with which the joining elements can be supplied individually from the storage groove to the head piece of the setting device.

Based on this known state of the art, it is an object of the present invention to provide an alternative supply device for joining elements with which the joining element is supplied without the help of compressed air through a, preferably profiled, supply hose or channel in every spatial position, i.e. also against gravity, in a reliable manner to a desired position. It is also an object to provide a corresponding setting tool as well as an associated supply method. Finally, it is an object to provide a setting method for inserting the joining element into at least one component.

SUMMARY OF THE INVENTION

The above object is solved by a supply device according to the independent claim 1, a setting tool for setting joining elements according to the independent claim 14, a supply method by using the supply device according to the independent claim 16 as well as a setting method by using the supply device according to the independent claim 17. Advantageous embodiments and further developments result from the following description, the drawings as well as the appending claims.

An inventive supply device for joining elements comprises a receiving portion for at least one joining element, in which a joining element is receivable and positionable in front of a first opening, a circumferentially closed hose of a flexible material which on a first end is connected with the receiving portion and on an opposite, second end with a discharge portion, as well as a flexible thrust element which is movable back and forth by means of a drive means through the hose between a retracted position in which a front end of the thrust element is located in the receiving portion and an extended position in which the front end of the thrust element is located in the discharge portion, so that the joining element which is located in front of the first opening is pushable out of the receiving portion with the thrust element through the hose into the discharge portion.

For a better comprehensibility, the inventive supply device is explained based on the use in combination with a setting tool. For example, the setting tool comprises a setting head with a punch as well as a die that is arranged opposite the punch. The setting tool is mounted to a C-frame as a carrier, which is for example movable by means of a robot. Furthermore, there is a joining element source, wherein the joining elements may be rivets for example. Alternatively, the joining elements are screws which will be discussed later in context with a preferred embodiment.

The joining elements are supplied from the joining element source to the receiving portion of the inventive supply device. In doing so, the joining elements can already be supplied individually or a plurality of joining elements is provided. If the joining element or one of the joining elements in case of a plurality of joining elements is not yet positioned in front of the first opening in the receiving portion, firstly, the respective positioning of the joining element in front of the first opening takes place. This will be explained later.

The flexible thrust element which is present in the receiving portion and which is in the retracted position is now moved through the first opening in the direction of the discharge portion. This takes place via the drive means. With this movement, the flexible thrust element pushes the joining element in front of it, out from the receiving portion and into the hose. When using rivets or the same as joining element, the flexible thrust element grabs the joining element transverse with respect to the longitudinal axis of the joining element. In order to guarantee that the joining element does not cant in the hose in this process, the hose is configured as a profile hose.

Corresponding profile hoses are known from the field of compressed air supply of joining elements. They are configured circumferentially closed and on the inside, they feature a cross-sectional form which corresponds to the cross-sectional form of the joining element to be supplied, i.e. it is for example T-shaped.

The hose connects the receiving portion, which is located remote from the setting head, e.g. at the robot arm, with the discharge portion that is arranged adjacent to the setting head of the setting tool. Due to this distance and the different positions, which may be assumed by the setting tool in the room due to the robot guidance, the hose usually has a curvilinear course, i.e. a plurality of curves and bendings. Therefore, in order to transport the joining element with the thrust element through the hose to the discharge portion, the thrust element must be capable of following the course of the hose. For this reason, the thrust element according to the present invention is configured flexible.

Due to the arrangement remote from one another, a length of the hose is preferably at least 50 cm, preferably at least 60 cm and particularly preferred at least 70 cm. By that, it is clear that in comparison with the state of the art, the receiving portion is particularly not arranged directly adjacent to the setting head.

As soon as the joining element has passed the discharge portion, it is discharged to the setting head in the underlying example. In other examples, the supply device may generally be used for transporting joining elements from a first position to a remote second position. In other words, the supply device can also be used in other sections of the supply between the joining element source and a processing or further processing position of the joining element. This may also be particularly advantageous when using screws as joining elements, which will be clarified later with reference to a preferred embodiment.

A general advantage of this device is that no pneumatic components are necessary to move a joining element from a first position, i.e. the receiving portion, to a second position, i.e. the discharge portion. This has an advantageous effect with regard to the arising costs as well as sustainability. In this context, it is particularly the use of the flexible thrust element which guarantees that the joining element is reliably transported from the receiving portion to the discharge portion in every spatial position, i.e. also against gravity.

In a preferred embodiment of the supply device, the receiving portion furthermore comprises a singulation means in order to separate a joining element from a plurality of joining elements and to position it in front of the first opening, preferably a mechanical singulation means. This is particularly advantageous when the receiving portion is provided with a plurality of joining elements. This is for example the case when the receiving portion is connected with an accumulation line for joining elements or with a joining element magazine.

Here, the singulation means guarantees that only one joining element at a time is transported from the receiving portion to the discharge portion through the hose. In order to avoid the use of pneumatic components at this point as well, the singulation means is a mechanical singulation means in particular, e.g. a mechanically operated slide or the like.

Advantageously, the thrust element comprises one of the following: a spring rod, preferably a spring rod wound on block, an elastomer rod, an element string, a steel rope, a Bowden cable or a spring sheet that is rigid in compression. By selecting the thrust element, the supply device can be adapted optimally to the respective application case, e.g. with regard to the space that is available. Generally, each element may be considered as thrust element which is able to follow a curvilinear course of the hose between the receiving portion and the discharge portion. In this regard, it must be considered that the thrust element ideally does not or only little compress under pressure in order to provide a proper transportation of the joining element to the discharge portion. In this context, particularly the preferred length of the hose of at least 50 cm should be considered, as the thrust element must also have at least this length so as to transport the joining element from the receiving portion to the discharge portion. This can be achieved in a particularly advantageous manner due to the spring rod that is wound on block, which is clarified later.

According to a further preferred embodiment of the supply device, the hose is a profile hose and the thrust element comprises a retaining device for the joining element adjacent to the front end of the thrust element, in particular a form piece or two retaining arms. In this context, it is particularly preferred that the retaining device comprises a form piece having an outer contour which is configured so as to match a contour of the joining element and/or an inner contour of the profile hose, and/or tapers at an end facing the thrust element. As indicated in the beginning with respect to rivets as exemplary joining elements, this embodiment is configured in a way that the thrust element engages the joining element laterally, i.e. perpendicular to a longitudinal axis of the joining element. For this reason the use of a profile hose as the hose is again necessary to avoid a canting or tilting of the joining element in the hose.

Due to the retaining device which is provided at the thrust element, it is guaranteed that the joining element abuts the thrust element, i.e. ideally does not disconnect from the thrust element, either. This function is particularly supported by a correspondingly adapted form piece. Furthermore, this design has a particularly advantageous effect depending on the chosen kind of supervision for the proper transportation of the joining element to the discharge portion, which will be explained later.

The tapered configuration of the form piece at the end which faces the thrust element causes the thrust element to be pullable with as little friction as possible through the hose which is configured as a profile hose in case of a return stroke of the thrust element, i.e. with a movement from the extended into the retracted position, particularly in case of a curvilinear course of the profile hose. Without the tapered configuration, the thrust element could, e.g. when using a spring rod as the thrust element, first of all become longer and then suddenly rebound when the force which is necessary to overcome the clamping location is reached.

In a further preferred embodiment of the supply device, the thrust element comprises a transmission means adjacent to the front end which can be engaged with a head of the joining element so that a rotation of the thrust element can be transferred onto the joining element. This configuration is particularly directed to the use of screws as joining elements. At their head end, they have an inner and/or outer form which allows the engagement by a tool so as to rotate the joining element that is configured as a screw. In order to come into engagement with this form, the thrust element comprises the correspondingly designed transmission means. Thus, in contrast to the previous example, the thrust element does not engage the joining element perpendicular to the longitudinal axis of the joining element but along the longitudinal axis of the joining element. The use of a profile hose as hose is thus not possible.

Furthermore, the thrust element, which is preferably formed as a flexible shaft, is provided with a second drive means which sets the thrust element into rotation. The rotation of the thrust element may be transferred to the joining element so that the screw as joining element may be screwed into at least one component, preferably into at least two components.

Thus, during the use, the screw as the joining element is thus pushed from the receiving portion through the hose to the discharge portion in the above-described manner. Preferably, in this context, the discharge portion is not arranged at a setting head of a setting tool but ends at a component, e.g. it attaches it. Once the thrust element has pushed the joining element through the hose, a tip of the joining element attaches the first component. Due to the preferably rigid configuration of the discharge portion, the joining element is therefore additionally securely positioned in radial direction.

When the second drive means is now activated, it sets the thrust element into rotation, which is transmitted onto the joining element by the transmission means. Thus, the joining element can be set into at least the first component. Preferably, the thrust element transmits a torque between 3 Nm and 30 Nm, preferably up to 15 Nm.

Advantageously, the thrust element is at least partly wound on a drum or arranged in a housing when in the retracted state. Due to this configuration, the corresponding application requirement can be fulfilled further, particularly in connection with the choice of the suitable thrust element. In this respect, reference is made to the above explanations regarding the different preferred kinds of thrust elements.

With regard to the dimensioning, it is particularly preferred that the thrust element has a cross-sectional area between 30% and 80% of the cross-sectional area of the hose. This is particularly true when using a profile hose as the hose. The cross-sectional area of the thrust element is calculated based on the outer diameter or the outer dimensions of the thrust element, independent of its actual design. This guarantees in particular that the thrust element does not attach the inner wall of a profile hose in a zigzag manner, as this would lead to a deviation between the length of the profile hose and a length of the thrust element in the profile hose. This length is, however, important so that the joining element is properly transported to the discharge portion and, if needed, passes same, and that the actual position is correctly determined, too. By that, a monitoring of the proper transportation of the joining element is improved, which will be explained later, too.

Preferably, the drive means comprises an electric, pneumatic or hydraulic actuator. The use of an electric actuator is particularly preferred as that way, the supply device can completely do without any pneumatic component. When selecting the actuator, the equipment which is already available at the setting tool or the operation site can additionally be important. That is, a supply network with compressed air or the like which is already existent could be accessed and as actuator, a pneumatic actuator or a hydraulic actuator could be selected.

Furthermore, it is preferred that the drive means comprises two wheels between which the thrust element is guided and of which at least one is driven. In this context, it is advantageous that at least one of the two wheels, preferably both wheels, has a knurling, an elastomer coating or an elastomer ring, and/or one wheel is arranged in a preloaded manner in the direction of the other wheel, in particular spring-pretensioned. It is particularly the outer contour and the material of the drive wheel or the wheels, but also the preloaded arrangement, which cause a friction that is as high as possible in the contact area with the thrust element. That way, a relative movement between the wheels and the thrust element is avoided, which has a positive effect on the proper function of the supply device.

In an advantageous embodiment, the supply device furthermore comprises at least one of the following sensors: a path sensor, a force sensor, a torque sensor and/or a speed sensor. The respective sensors are preferred particularly in combination with two wheels as drive means. For example, the use of the sensors in connection with a spring rod as the thrust element as well as when using a path sensor and thus a path control is explained.

In this context, it should first of all be considered that particularly in case of a path-controlled supply of the joining element from the receiving portion to the discharge portion, the thrust element must not be compressed if possible. For example, this could be achieved by using a spring rod that is wound on block as the thrust element.

In case of a force-controlled variant, a compression of the thrust element could also lead to problems, as the increase in force would arrive at the drive means and a force sensor used there in a considerably reduced or belated manner.

In order to avoid this, a position sensor could alternatively or additionally be used. This sensor in particular will recognize if the joining element has reached the desired position in the discharge portion or in supply direction behind the discharge portion, e.g. adjacent to or under the punch of the setting head.

In case of the exemplary path control, the path sensor detects after each return stroke if the thrust element is in the retracted position again. That is, the path before each new supply process is set to zero. The distance to be covered during the forward stroke is for example defined by means of the revolutions of the engine shaft. A conversion of the revolutions of the engine shaft into the covered path of the thrust element takes place by means of the effective diameter of the drive wheel.

Alternatively, the torque of the engine and the friction of the drive wheel is selected so that the engine stops when the joining element has reached the desired position in the discharge portion or in the supply direction behind same, e.g. in the setting head, and the thrust element cannot be pushed further. This state can for example also be detected by means of a speed sensor, as in this case, the current speed of the thrust element is zero.

An inventive setting tool for setting joining elements comprises the inventive supply device. Thus, the inventive setting tool uses the inventive supply device for the supply of the joining elements.

With respect to the arising technical effects and advantages, reference is made to the above explanations regarding the supply device in order to avoid repetitions.

In a preferred embodiment of the setting tool, the discharge portion is arranged adjacent to a setting head of the setting tool and the receiving portion is arranged remote from the setting head so that the joining element is dischargeable through the discharge portion to the setting tool, in particular to the setting head of the setting tool. In connection with this configuration, the supply device provides the last section of the supply to the setting head. As the supply device does not need any pneumatic components for the supply of the joining element to the setting head, a supply without compressed air can thus be realized.

As an alternative to this preferred embodiment, the supply device can also be used in a way that with same, a screw as joining element can for example be inserted or set into a component. For this purpose, the thrust element comprises the transmission means which can be engaged with the head end of the joining element. That way, a rotation movement applied to the thrust element is transferred to the screw as joining element so that same is screwed into the component or a plurality of components. With regard to the details, reference is made to the explanations regarding the above-discussed preferred embodiment.

An inventive supply method using the inventive supply device comprises the steps: supplying a joining element to the receiving portion of the supply device, positioning the joining element in front of the first opening in the receiving portion so that the joining element is arranged in front of a flexible thrust element, moving the thrust element from a retracted state into an extended state, so that the joining element positioned in front of the thrust element is moved in the direction of the discharge portion through the hose, discharging the joining element when it reaches the discharge portion and moving back the flexible thrust element from the extended into the retracted position. For supplying the joining element, the inventive supply method uses the inventive supply device. Therefore, reference is again made to the above explanations in this regard in order to avoid repetitions. Preferably, the supply method in connection with a setting tool is used so that the supply device realizes the last section of the supply of joining elements to the setting head of the setting tool, as explained above. Depending on the desired functions and the desired coordination of the supply of joining elements, the supply method can be operated by a control assigned to the supply device, a control assigned to the setting tool, or a control assigned to the robot. Particularly the control which is assigned to the supply device can be subordinated with respect to the control assigned to the setting tool.

An inventive setting method uses an embodiment of the inventive supply device with the thrust element comprising the transmission means that may be engaged with a head of the joining element. The setting method comprises the steps: supplying a joining element to the receiving portion of the supply device, positioning the joining element in front of the first opening in the receiving portion so that the joining element is arranged in front of the flexible thrust element, moving the thrust element from a retracted state into an extended state so that the joining element which is positioned in front of the thrust element is moved in the direction of the discharge portion through the hose, applying a torque on the joining element by means of the transmission means at the front end of the thrust element by means of a second drive means when reaching the discharge portion and thus setting the joining element into at least one component with the thrust element preferably transmitting a torque between 3 Nm and 30 Nm, particularly preferred up to 15 Nm. Besides the pushing of the joining element through the hose, the joining element can thus be set into rotation by means of the thrust element. This method is therefore particularly suitable for joining elements with an engaging means provided at the head, e.g. screws or the like. In this context, particular reference is made to the preferred configuration of the supply device with transmission means at the thrust element.

SHORT SUMMARY OF THE DRAWINGS

Figure 2:
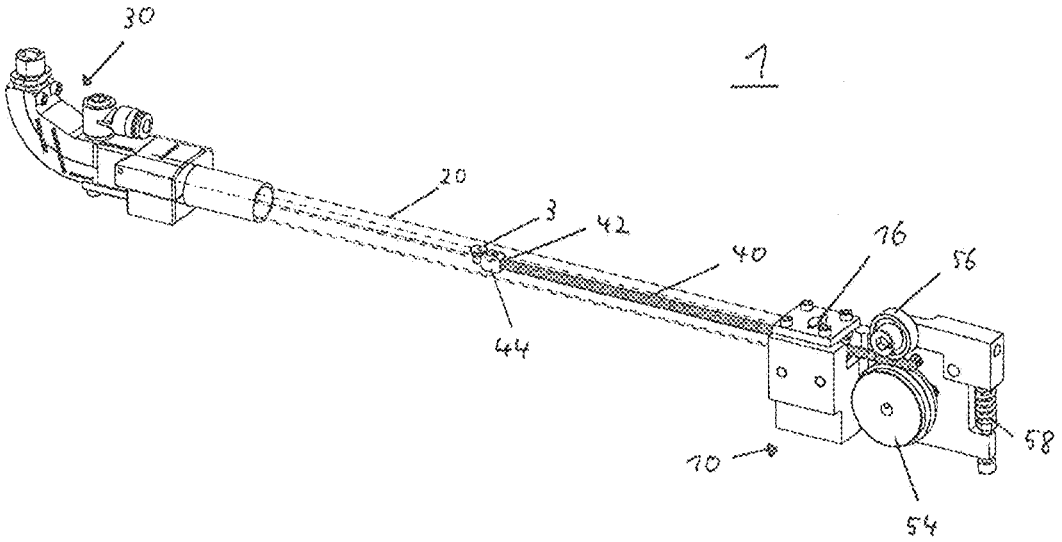
Figure 3:
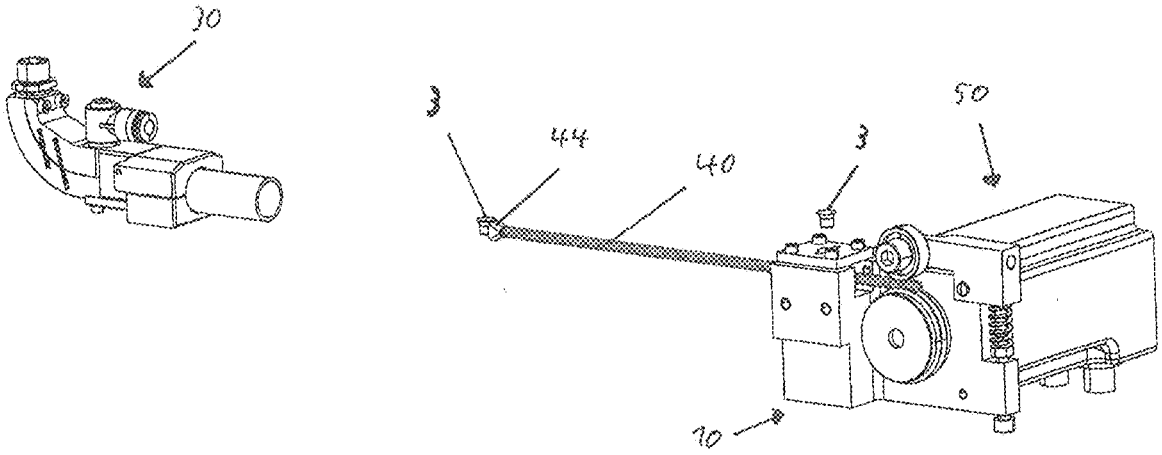
Figure 4:
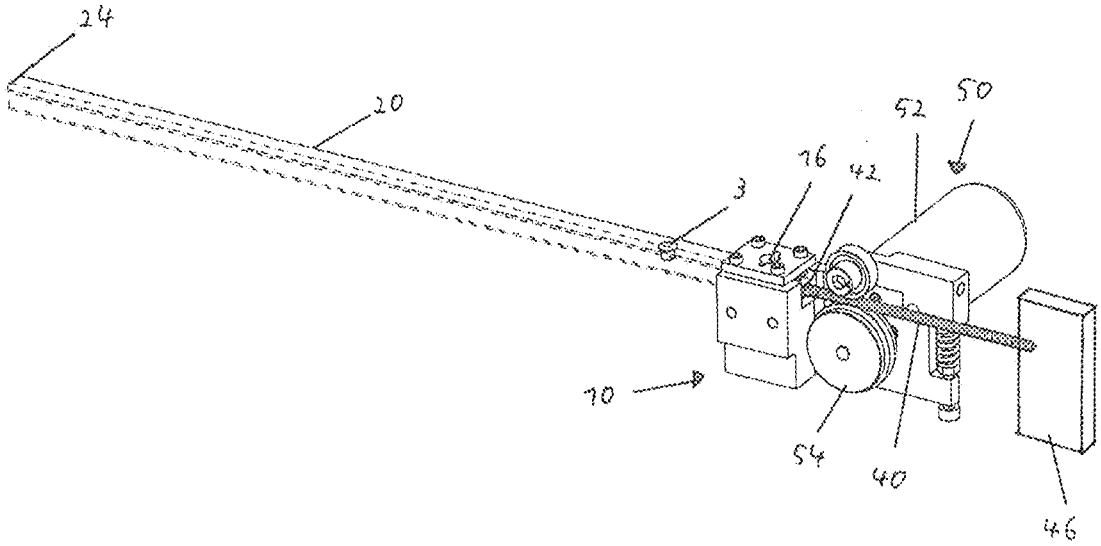
Figure 5:
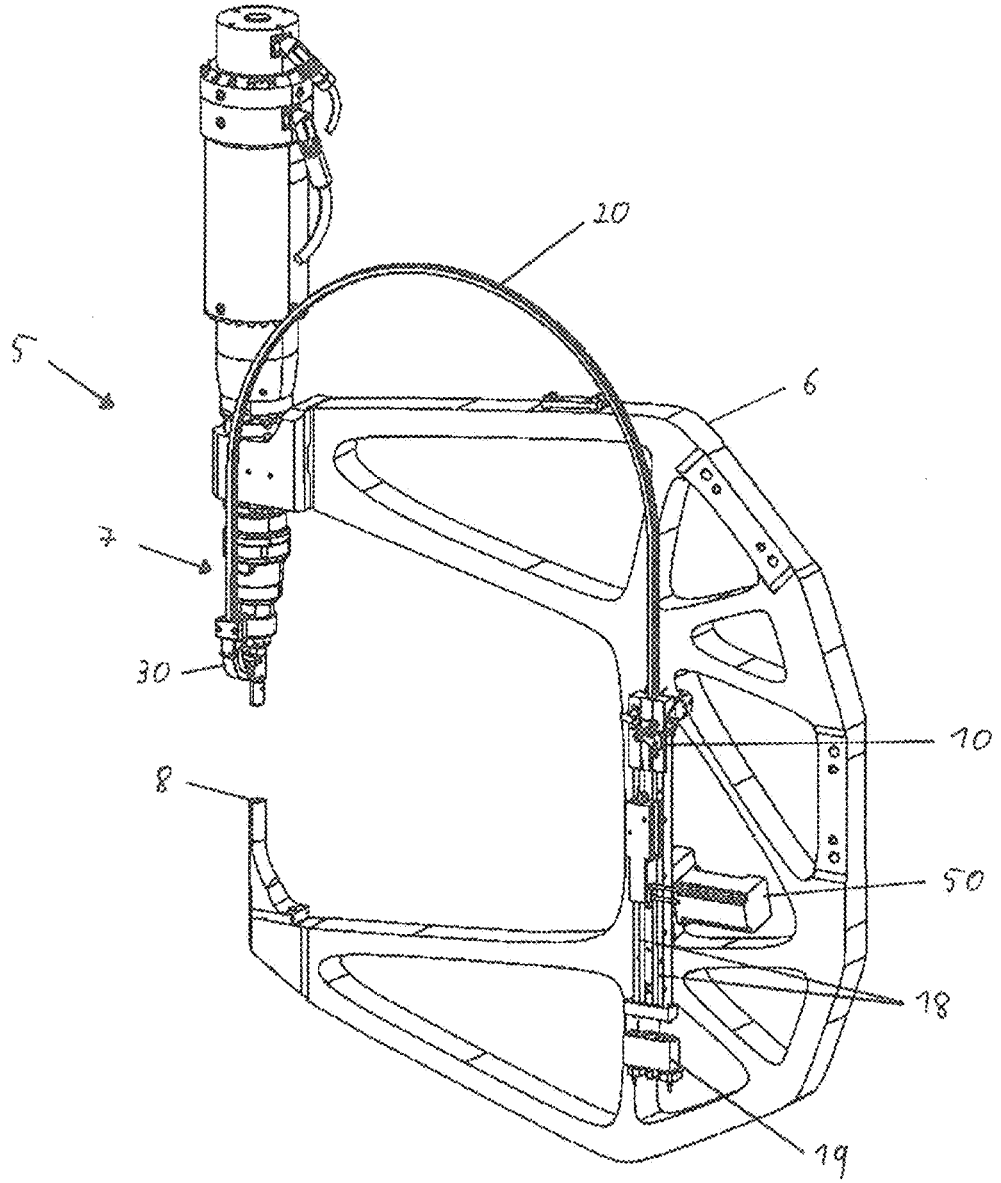
Figure 6:
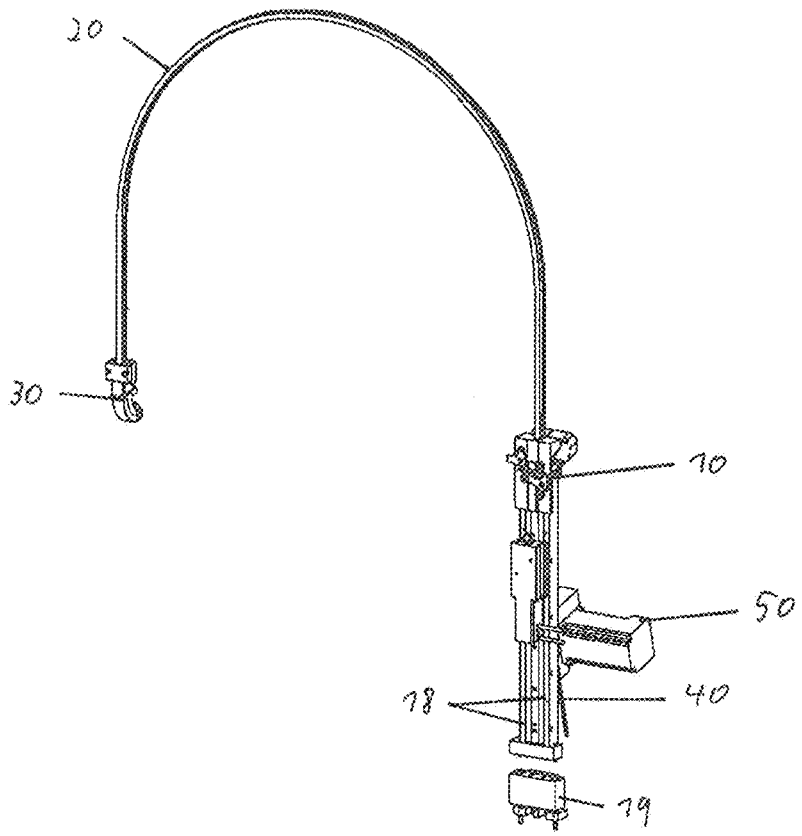
Figure 7:
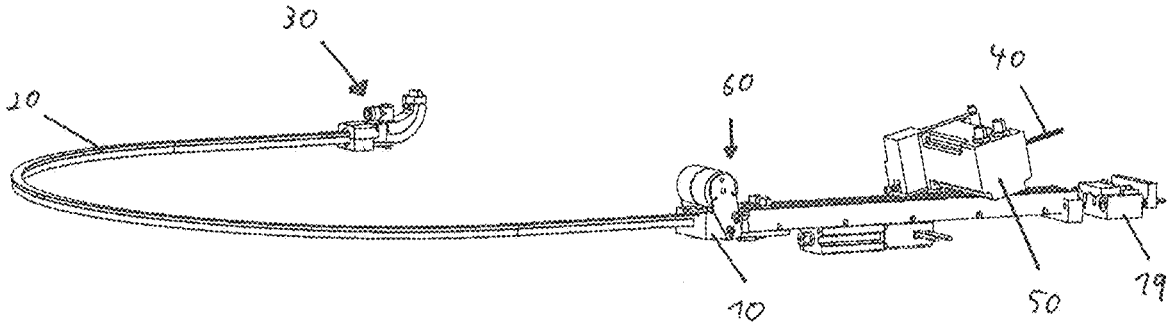
Figure 8:
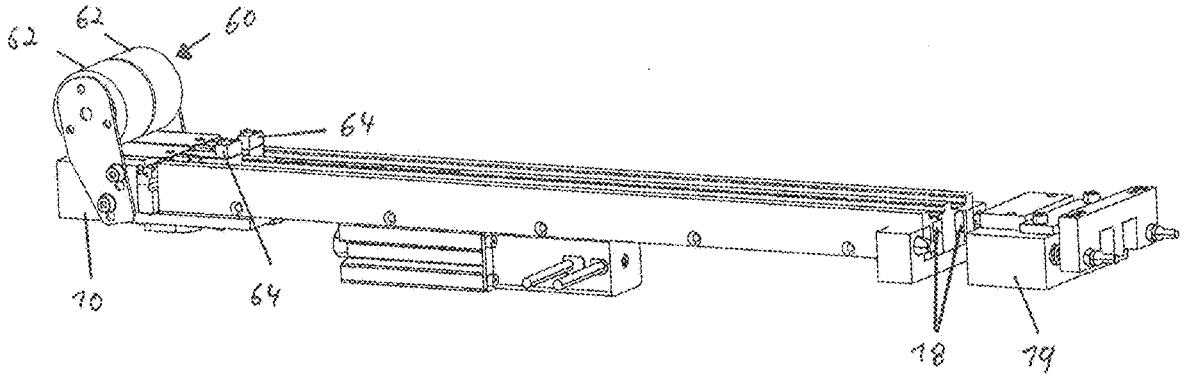
Figure 9:
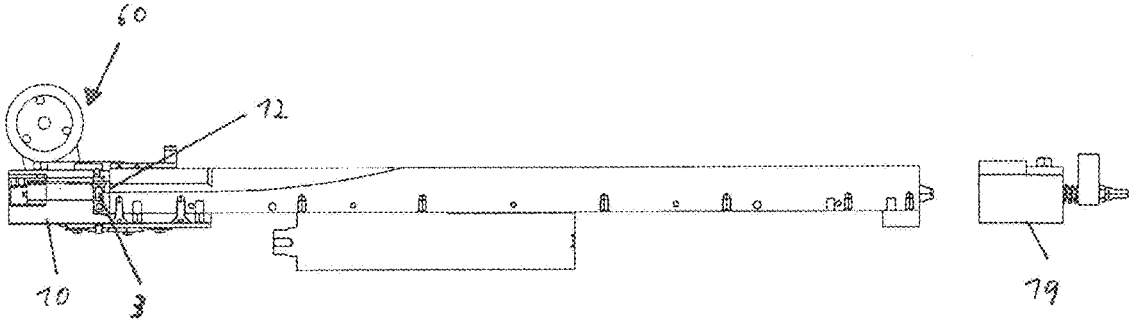
Figure 10:
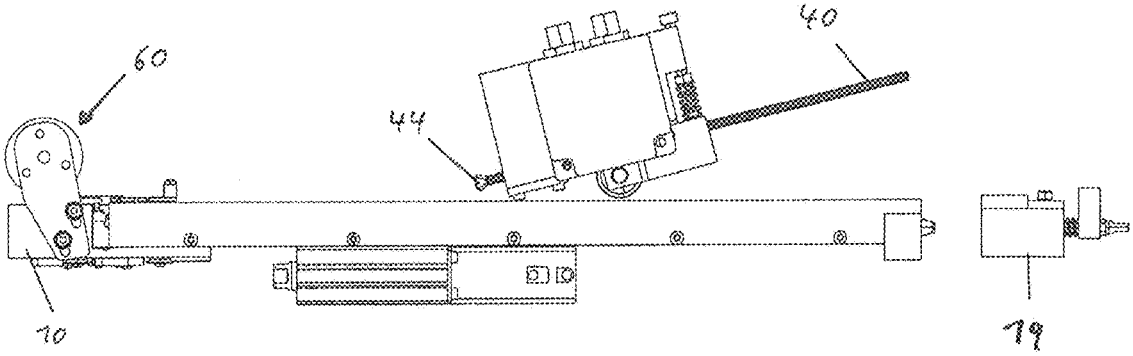
Figure 11:
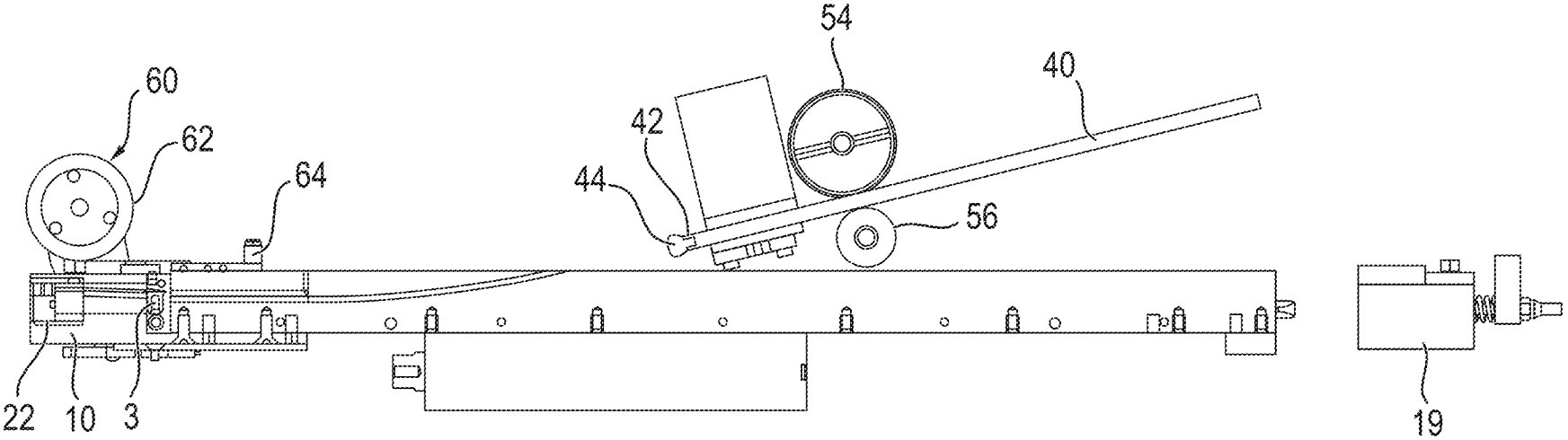
Figure 12:
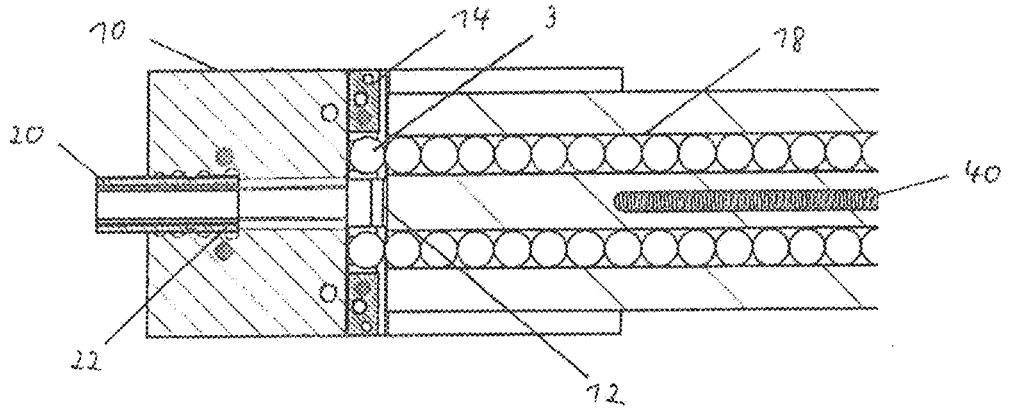
Figure 13:
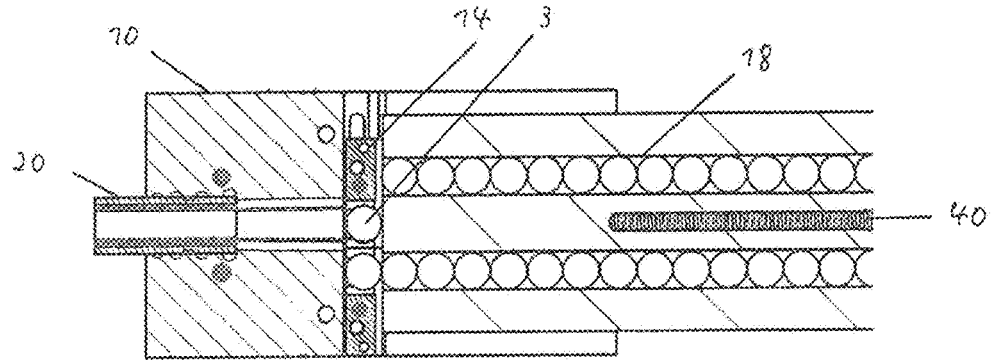
Figure 14:
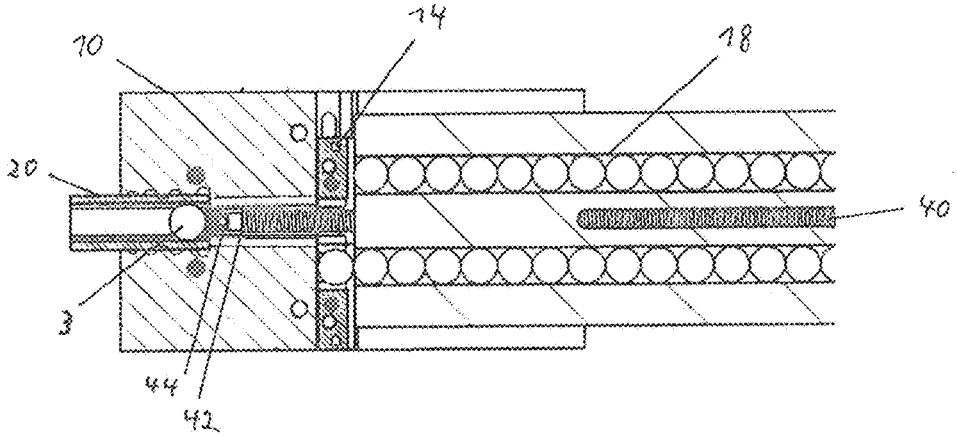
Figure 15:
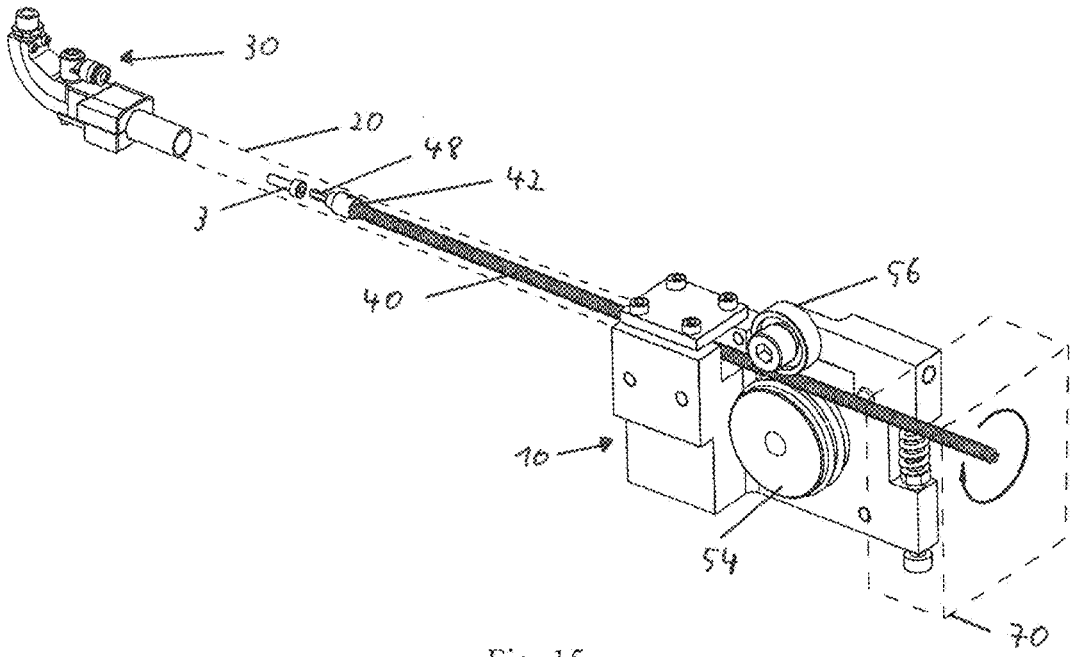
Figure 16:
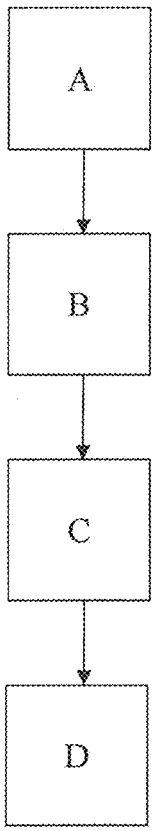
Figure 17:
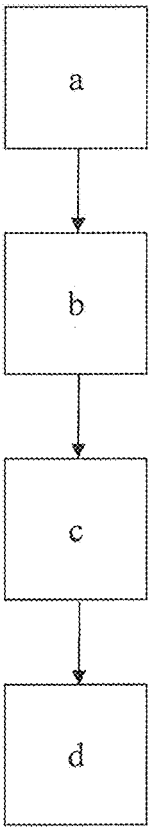

In the following, the present invention is described in detail based on the drawings. In the drawings, the same reference signs refer to the same components and/or elements. They show:

FIG. 1 a first perspective view of a first embodiment of an inventive supply device, FIG. 2 a second perspective view of the first embodiment of an inventive supply device with semitransparent profile hose, FIG. 3 a perspective view of the supply device of FIG. 1 without profile hose, FIG. 4 a perspective partial view of the supply device of FIG. 2 without discharge portion, FIG. 5 a perspective view of an embodiment of a setting tool with a second embodiment of an inventive supply device, FIG. 6 a first perspective view of the second embodiment of the inventive supply device according to FIG. 5, FIG. 7 a second perspective view of the second embodiment of the inventive supply device according to FIG. 5, FIG. 8 a perspective view of the receiving portion of the supply device according to FIG. 5, FIG. 9 a sectional view of the receiving portion of the supply device according to FIG. 8, FIG. 10 a lateral view of the receiving portion as well as the drive means and the thrust element according to FIG. 5, FIG. 11 a sectional view of the receiving portion as well as the drive means and the thrust element according to FIG. 10, FIG. 12 a partial sectional view of the receiving portion of the second embodiment of the supply device in an initial state, FIG. 13 a partial sectional view of the receiving portion of the second embodiment of the supply device in a loaded state, FIG. 14 a partial sectional view of the receiving portion of the second embodiment of the supply device in a transport state, FIG. 15 a perspective view of a further embodiment of an inventive supply device with transmission means at the thrust element, FIG. 16 a schematic course of proceeding of an embodiment of a supply method and FIG. 17 a schematic course of proceeding of an embodiment of a setting method by using a supply device with a transmission means at the thrust element.

DETAILED DESCRIPTION OF THE PREFERRED EMBODIMENTS

For better comprehensibility and with reference to the FIGS. 1 to 4, an embodiment of the inventive supply device 1 is described based on its use. Preferably, the supply device 1 in connection with a setting tool 5 is used, which comprises a setting head 7 with a punch as well as a die 8 that is arranged opposite the punch. The setting tool 5 is mounted to a C-frame 6 as a carrier, which is movable in a robot-guided manner (also see FIG. 5). Furthermore, a joining element source is present. The joining elements 3 are, for example, rivets.

The supply device 1 comprises a receiving portion 10 for at least a joining element 3, a circumferentially closed hose 20 out of flexible material, a discharge portion 30 as well as a flexible thrust element 40. At a first end 22, the hose 20 is connected to the receiving portion 10 and at an opposite second end 24, it is connected to the discharge portion 30.

When used with a setting tool, the discharge portion 30 is preferably arranged at or adjacent to the setting head, in particular the punch of the setting head. In the illustrated embodiment, the discharge portion 30 has an arcuate shape so that between an entry end and an exit end of the joining element 3 into the receiving portion 30, there is an angle of 90°. The receiving portion 10 is provided at a distance to the setting head.

Due to this distance between the receiving portion 10 and the discharge portion 30 as well as the different positions which the setting tool can assume in the room due to for example the robot guidance, the hose 20 usually has a curvilinear course. Therefore, it has a plurality of curves and bendings. Thus, in order to transport the joining element 3 with the thrust element 40 through the hose 20 to the discharge portion 30, the thrust element 40 must be capable of following the course of the hose 20. Therefore, the thrust element 40 is configured flexibly. Furthermore, it should be observed that a length of the hose 20 is for example at least 50 cm, preferably at least 60 cm and particularly preferred at least 70 cm, further emphasizing the distance between the receiving portion and the discharge portion 30.

Furthermore, in the configuration which is shown here, rivets are used as joining element 3. With this kind of joining elements 3, the thrust element 40 engages the joining element 3 transverse to a longitudinal axis of same. Therefore, in order to avoid a canting or tilting of the joining element 3 in the hose 20, the hose 20 is preferably formed as a profile hose.

Corresponding, flexible profile hoses are known from the field of compressed air supply of joining elements 3. They are configured circumferentially closed and on their inside, they have a cross-sectional form which corresponds to the cross-sectional form of the joining element 3 to be transported. In the illustrated example, the cross-sectional form is therefore T shaped.

In the illustrated embodiment, the thrust element 40 is a spring rod. Alternatively, the use of an elastomer rod, an element string, a steel rope, a Bowden cable or a spring sheet that is rigid in compression is preferred. By selecting the respective, suitable thrust element 40, the supply device 1 can be adapted effectively to the respective application case, e.g. with regard to the available assembly space. Here, every element being capable of following a curvilinear course in the hose 20 between receiving portion 10 and discharge portion 30 is suitable as thrust element 40.

It should be ensured, however, that the thrust element 40 ideally does not or only little compress in case of pressure in order to guarantee a proper transport of the joining element 3 to the discharge portion 30. In this context, the length of the hose 20 of at least 50 cm should be ensured, too, because the thrust element 40 must have this length at least in order to transport the joining element 3 from the receiving portion 10 into the discharge portion 30.

In order to guarantee that the thrust element 40 is not or only little compressed in thrust direction, the thrust element 40 is at least partly wound on a drum in the retracted state, or is arranged in a housing. The drum or the housing are marked with reference sign 46.

The dimensioning of the cross section of the thrust element 40 also has an advantageous effect on the functionality. Thus, the thrust element 40 has a cross-sectional area in the illustrated embodiment which lies between 30 and 80% of the cross-sectional area of the hose 20. This is particularly true with respect to the use of a profile hose as hose 20.

The cross-sectional area of the thrust element 40 is calculated solely based on its outer diameter or its outer dimensionings, independent of its actual design. By that, it is guaranteed that the thrust element 40 does not attach an inner wall of the hose 20 in a zigzag manner, as this would lead to a deviation between the length of the hose 20 and the length of the thrust element 40 in the hose 20. However, this length is important so that the joining element 3 is transported properly to the discharge portion 30 and that this is determined properly, which will be explained in connection with the use.

When using the supply device 1, the joining elements 3 are supplied to the receiving portion 10 from the joining element source. For this purpose, the receiving portion 10 comprises a supply opening 16. In the illustrated embodiment of FIGS. 1 and 2, this supply opening 16 is located in a lid plate of the receiving portion 10. That way, the joining element 3 reaches the receiving portion 10 and is positioned in front of the first opening 12 (cf. FIG. 3).

The supply of the joining element 3 from the receiving portion 10 towards the discharge portion 30 takes place by means of the thrust element 40. For this purpose, the thrust element 40 is moved from a retracted position, in which it is located in the receiving portion 10, into an extended position, in which it is located in the discharge portion 30. In the illustrated example, the thrust element 40 along with the joining element 3 is located in the hose 20. In doing so, the thrust element 40 engages the joining element 3 laterally, i.e. from a direction perpendicular to the longitudinal axis of the joining element 3.

A retaining device 44 is provided at a front end 42 of the thrust element 40 so that the joining element 3 attaches the thrust element 40, i.e. ideally does not move away from the thrust element 40 due to gravity. The retaining device 44 is, in particular, a form piece or two retaining arms. The configuration with the retaining device 44 is preferred in particular in connection with a profile hose as hose 20.

In the illustrated configuration, the retaining device 44 is a form piece having an outer contour matching a contour of the joining element 3 and matching an inner contour of the profile hose as hose 20. Furthermore, the form piece as retaining device 44 is tapered at an end facing the thrust element 40. The tapered configuration of the form piece or the retaining device 44, respectively, at the end which faces the thrust element 40 causes the thrust element 40 to be pullable through the profile hose with as little friction as possible in case of a return stroke of the thrust element 40, i.e. in case of a movement from the extended into the retracted position. This applies in particular in case of a curvilinear course of the profile hose.

The movement of the thrust element 40 through the hose 20 between a retracted position in which the thrust element 40 is located in the receiving portion 10, and an extended position in which the thrust element 40 is located in the discharge portion 30, is achieved by means of a corresponding drive means 50. For this purpose, the drive means 50 comprises an electric actuator 52 in the illustrated embodiment, e.g. an electric engine. Particularly the use of an electric actuator 52 is specifically preferred as that way, the supply device 1 can completely do without any pneumatic component.

Alternatively, when selecting the drive means 50, an operating means available at the setting tool 5 or the place of application can be taken into consideration. That is, alternatively to the electric actuator 52, an already existing supply network with compressed air or the like can be accessed, and as actuator, a pneumatic actuator or a hydraulic actuator can be selected for the drive means 50.

Furthermore, the drive means 50 comprises two wheels 54, 56. The thrust element 40 is guided between the wheels 54, 56. A first wheel 54 is driven by means of the actuator 52. At least one of the two wheels 54, 56 has a knurling, an elastomer coating or an elastomer ring. Furthermore, the second wheel 56 is arranged in a spring-preloaded manner in the direction of the first wheel 54 by means of a spring 58.

It is in particular the outer contour and the material of the first wheel 54, i.e. the drive wheel, but also the preloaded arrangement, which ensure that in the contact portion between the wheels 54, 56 and the thrust element 40, a friction is caused which is as high as possible. By that, a relative movement between the wheels 54, 56 and the thrust element 40 is avoided. This has a positive effect on the proper functioning of the supply device 1.

In order to control and/or supervise the supply of the joining element 3, the supply device 1 comprises at least one of the following sensors: a path sensor, a force sensor, a torque sensor and/or a speed sensor.

Particularly in case of the preferred, path-controlled supply of the joining element 3 from the receiving portion 10 to the discharge portion 30, the thrust element 40 must not be compressed if possible. This can for example be achieved by using a spring rod that is wound on block as the thrust element 40, as explained in the beginning.

For the sake of completeness, it is pointed out in this context that in case of a force-controlled variant, too, a compression of the thrust element 40 would lead to problems. The reason for that is that a force increase would arrive at the drive means 50 and a force sensor used there in a considerably reduced or belated manner.

In order to avoid the disadvantages which come along with a compression of the thrust element 40, a position sensor can alternatively or additionally be used. It recognizes if the joining element 3 has reached the desired position in the discharge portion or in the supply direction of the joining element 3 behind the discharge portion 30.

In case of the exemplary path control, the path sensor detects after every return stroke, i.e. after each movement from the extended position into the retracted position, that the thrust element 40 is again arranged in the retracted position, i.e. after the first opening 12 in the receiving portion 10. That is, the way before each new supply process is set to zero in this case.

The distance to be covered in case of a front stroke, i.e. during the movement from the retracted into the extended position, is for example defined by means of the revolutions of an engine shaft of the drive means 50. A conversion of the revolutions of the engine shaft into the covered path of the thrust element 40 takes place by means of the effective diameter of the drive wheel, that is, in the illustrated example of the first wheel 52.

Alternatively, a torque of the engine and the friction of the drive wheel or the first wheel 52, respectively, is selected so that the engine stops when the joining element 3 has arrived in or through the discharge portion 30 at the desired position and the thrust element 40 cannot be pushed further. This state can for example also be detected with a speed sensor, as the actual speed of the thrust element 40 is zero in this case.

As soon as the joining element 3 has reached or passed the discharge portion 30, it is discharged to the setting head in the present example. In other examples, the supply device 1 can generally be used for transporting joining elements 3 from a first position to a remote second position.

An advantage of this supply device 1 is that no pneumatic components are needed for moving a joining element from this first position, i.e. the receiving portion 10, to a second position, i.e. the discharge portion 30. This has an advantageous effect particularly with regard to the arising costs as well as sustainability. Here, particularly the use of the flexible thrust element 40 ensures that the joining element 3 is reliably transported from the receiving portion 10 to the discharge portion 30 in every spatial position, i.e. also against gravity.

With reference to FIG. 5, a setting tool 5 with a second embodiment of the supply device 1 is shown now. It differs from the first embodiment mainly due to the design of the receiving portion 10, which is explained later with reference to FIGS. 6 to 14.

Firstly, again with reference to the configuration of the setting tool 5, same has a setting head 7 and a die 8, which are both mounted to the C-frame 6 as carrier. The C-frame 6 is for example movable in a robot-guided manner.

The receiving portion 10 of the supply device 1 is mounted to the C-frame 6. In the illustrated example, this takes place at the perpendicular portion of the C-form which connects the two horizontal protrusions. As already explained before, the receiving portion 10 is connected with the discharge portion 30 by means of the hose 20. As illustrated, the discharge portion 30 is arranged at the setting head 7.

In contrast to the previous configuration, the joining elements 3 are not supplied individually but by means of two accumulation lines 18 to the receiving portion 10. The accumulation lines 18 can be assigned to a separate housing which is connected to the receiving portion 10, or can be an integral part of the receiving portion 10. As a result, the joining elements 3 are thus not fed individually to the receiving portion 10, but rather, there is a plurality of joining elements 3 in the accumulation lines 18.

Therefore, the drive means 50 is arranged adjacent to a housing of the accumulation lines 18. The accumulation lines 18 are provided with a matching lid so that no joining elements 3 can fall out of the accumulation line. Furthermore, the presence of a docking station 19 is shown.

FIGS. 6 and 7 show the arrangement according to FIG. 5 without the C-frame 6, the setting head 7 and the die 8, in order to improve comprehensibility. In particular in FIG. 7, it can be seen that a clamping device 60 is provided at the receiving portion, so as to maintain the joining elements 3 present in the accumulation lines 18 in abutment with each other.

As can be seen in FIG. 8 in particular, the accumulation lines 18 are designed for different joining elements 3. That is, the left or front accumulation line 18 is designed for joining elements 3 with a shorter shaft, while the right or rear accumulation line 18 is designed for joining elements 3 with a longer shaft. The arrangement of the accumulation lines 18 can certainly also be made vice versa or joining elements 3 of the same kind can be present in both accumulation lines 18.

The clamping device 60 comprises two clamping rollers or rollers 62. A flexible element is wound on them, with which by means of corresponding clamping pieces 64, a tension can be applied on the joining elements 3 present in the accumulation line 18 in the direction of the receiving portion 10.

For clarification, FIG. 9 shows a sectional view of the illustration of FIG. 8. Here, it can be seen that there is a channel between the accumulation lines 18, into which during operation, the thrust element 40 is inserted in order to transport a joining element 3, which is positioned in front of the first opening 12, into the profile hose 20 and to the discharge portion 30.

FIGS. 10 and 11 show the configuration according to FIGS. 8 and 9 together with the drive means 50 and the thrust element 40 in a lateral view (FIG. 10) and a sectional view (FIG. 11). In operation, the drive means 50 moves the thrust element 40 with the retaining device 44 ahead into the channel and into abutment with the joining element 3 adjacent to the first opening 12 in the receiving portion 10. The route of the channel is particularly obvious from FIG. 11.

With reference to FIGS. 12 to 14, a sectional view of the alternative receiving portion 10 of the supply device 1 is now shown. Here, it becomes clear that the receiving portion 10 has a singulation means 14. That way, it is guaranteed that only one joining element 3 at a time is supplied to the discharge portion 30. As explained above, the thrust element 40 is guided into the receiving portion 10 via the channel and is located in or behind the first opening 12 in the retracted state. FIG. 12 shows the corresponding initial state.

If a joining element 3 is now supposed to be transported to the discharge portion 30, first of all, the singulation means 14 is actuated. This is a mechanical means, e.g. a mechanical slide, which is operated via an actuator. The singulation means 14 moves the joining element 3 in front of the first opening 12 and thus in front of the thrust element 40. This state is shown in FIG. 13. Depending on the orientation of the receiving portion 10 in the room, the corresponding positioning can also be carried out with the help of gravity.

The thrust element 40 as described above is now actuated, so that the joining element 3 is moved into the hose 20, in particular the profile hose, through the hose 20 and up to the discharge portion 30. The beginning of this state is illustrated in FIG. 14. Furthermore, reference is made to the above descriptions with respect to the functionality.

Thus, the singulation means 14 guarantees that always only one single joining element 3 at a time is supplied from the receiving portion 10 through the hose 20 and to the discharge portion 30.

Once the joining element 3 has been positioned and/or discharged in/into the discharge portion 30, the thrust element 40 is moved back through the hose 20 from the extended position into the retracted position. In this context, the tapered configuration of the form piece at the end which faces the thrust element 40 is of advantage, as this will cause the thrust element 40 to be pullable through the hose 20 with as little friction as possible in case of the return stroke of the thrust element 40, particularly in case of a curvilinear course of the hose 20. Without the tapered configuration, the thrust element 40 could firstly become longer and then suddenly rebound, e.g. when using a spring rod as thrust element 40, as soon as the force has been reached which is necessary to overcome the clamping location.

As soon as the thrust element 40 is again in the retracted position, the above-described process can be repeated and a new or another joining element 3 can be supplied to the discharge portion. With respect to the configuration with the accumulation line 18, the moved-up joining element 3 is thus positioned individually and in front of the opening 12, so that it can be supplied from the thrust element 40 to the discharge portion 30.

With reference to FIG. 15, an alternative configuration of the supply device 1 is now discussed. This configuration is used in particular in connection with a screw or the like as joining element.

In this configuration of the supply device 1, the thrust element 40 comprises a transmission means 48 adjacent to the front end 42. It may be engaged with a head of the joining element 3, e.g. the screw. At their head end, screws have an inner and/or outer form which allows the engagement of a tool so as to rotate the joining element 3 that is configured as a screw. The thrust element 40 comprises the correspondingly designed transmission means 48 in order to come into engagement with this form. In the illustrated example, the transmission means is an external hex so that the screw comprises a hexagon socket at its head.

In contrast to the previous example with the rivet as joining element 3, the thrust element 40 therefore does not engage the joining element 3 that is designed as a screw transverse to the longitudinal axis of the joining element 3 but along the longitudinal axis of the joining element 3. The use of a profile hose as hose 20 is therefore not possible.

Furthermore, the thrust element 40, which is preferably designed as a flexible shaft, is provided with a second drive means 70 which sets the thrust element 40 into rotation. The rotation of the thrust element 40 may be transferred onto the joining element 3 due to the transmission means 48, so that the screw as joining element 3 may be screwed or set into at least one component, preferably into at least two components.

During use, the screw as the joining element 3 is thus pushed through the hose 20 from the receiving portion 10 to the discharge portion 20 in the above-described manner. Preferably, in this process, the discharge portion 30 is not arranged to a setting head of a setting tool but ends at a component, i.e. it abuts it, for example. Therefore, once the thrust element 40 has pushed the joining element 3 through the hose 20, a tip of the joining element 3 attaches the first component. Due to the preferably rigid configuration of the discharge portion 30, the joining element 3 is furthermore securely positioned in radial direction.

When the second drive means 70 is now actuated, same sets the thrust element 40 into rotation, which is transmitted to the joining element 3 via the transmission means 48. Thus, the joining element 3 can be set into at least the first component. Preferably, when doing so, the thrust element transmits a torque between 3 Nm and 30 Nm, preferably up to 15 Nm.

With respect to FIG. 16, an embodiment of an inventive supply method by using an embodiment of the inventive supply device 1 is explained. In a first step A, a supplying of the joining element 3 to the receiving portion 10 of the supply device 1 takes place. Furthermore, the joining element 3 is positioned in front of the first opening in the receiving portion 10. This takes place in step B. At the end of this step, the joining element 3 is arranged in front of the flexible thrust element 40.

Now, in step C, the thrust element 40 is moved from a retracted state into an extended state. This takes place by means of the drive means 50. By that, the joining element 3 that is positioned in front of the thrust element 40 is moved in the direction of the discharge portion 30 through the hose 20.

Finally, in step D, the discharging of the joining element 3 takes place when the discharge portion 30, i.e. the desired position in the discharge portion 30 or in supply direction of the joining element 3 behind the discharge portion 30, is reached, as well as the moving back of the flexible thrust element 40 from the extended into the retracted position.

After that, the above method steps A to D can repeat, when the receiving portion 10 is already fed with individual joining elements 3. If the receiving portion 10 is already provided with a plurality of joining elements 3, e.g. due to an accumulation line 18, it is preferred that steps B to D be repeated.

Finally, with respect to FIG. 17, an embodiment of a setting method by using the supply device 1 with a transmission means 48 provided at the thrust element 40 is explained. Here, in a first step a, a supplying of the joining element 3 to the receiving portion 10 of the supply device 1 takes place. This step is followed by the subsequent step b where a positioning of the joining element 3 in front of the first opening 12 in the receiving portion 10 takes place, so that the joining element 3 is arranged in front of a flexible thrust element 40. In contrast to the previous embodiment, here, the joining element 3 is positioned so that the thrust element 40 engages the joining element 3 along the longitudinal axis of the joining element 3, preferably at the head of the joining element 3.

In step c, a moving of the thrust element 40 from a retracted state into an extended state takes place, so that the joining element 3 that is positioned in front of the thrust element 40 is moved in the direction of the discharge portion 30 through the hose 20.

Now, in step d, a torque is applied on the joining element 3 via the transmission means 48 at the front end 42 of the thrust element 40 by means of a second drive means 70 when the discharge portion 30 has been reached. By that, a setting of the joining element 3 into at least one component takes place, with the thrust element 40 preferably transmitting a torque between 3 Nm and 30 Nm, particularly preferred up to 15 Nm.

LIST OF REFERENCE SIGNS

1 supply device
3 joining element
5 setting tool
6 C-frame
7 setting head
8 die
10 receiving portion
12 first opening in the receiving portion 10
14 singulation means
16 supply opening
18 accumulation line
19 docking station
20 hose
22 first end of the hose
24 second end of the hose
30 discharge portion
40 thrust element
42 front end
44 retaining device
46 housing for the thrust element 40
48 transmission means
50 drive means
52 actuator
54 first wheel
56 second wheel
58 spring
60 clamping device
62 roller
64 clamping piece
70 second drive means

The invention claimed is:

1. A supply device for joining elements comprising:
a. a receiving portion for at least one joining element, in which a joining element is receivable and positionable in front of a first opening,
b. a circumferentially closed hose of a flexible material which on a first end is connected with the receiving portion and on an opposite, second end with a discharge portion, and
c. a flexible thrust element which is movable back and forth by means of a drive means through the hose between a retracted position in which a front end of the thrust element is located in the receiving portion and an extended position in which the front end of the thrust element is located in the discharge portion, so that the joining element which is positioned in front of the first opening is pushable with the thrust element out of the receiving portion through the hose into the discharge portion.

2. The supply device according to claim 1, wherein the receiving portion furthermore comprises a singulation means in order to separate a joining element from a plurality of joining elements and to position the joining element in front of the first opening, preferably a mechanical singulation means.

3. The supply device according to claim 1, wherein the thrust element comprises one of the following: a spring rod spring rod wound on block, an elastomer rod, an element string, a steel rope, a Bowden cable or a spring sheet that is rigid in compression.

4. The supply device according to claim 1, wherein the hose is a profile hose and the thrust element comprises a retaining device for the joining element adjacent to the front end of the thrust element.

5. The supply device according to claim 4, wherein the retaining device comprises a form piece which
a. has an outer contour that is configured so as to match a contour of the joining element and/or an inner contour of the profile hose, or
b. tapers at an end which faces the thrust element.

6. The supply device according to claim 1, wherein the thrust element comprises a transmission means adjacent to the front end which can be engaged with a head of the joining element so that a rotation of the thrust element can be transferred onto the joining element.

7. The supply device according to claim 1, wherein when in the retracted state, the thrust element is at least partly wound on a drum or arranged in a housing.

8. The supply device according to claim 1, wherein the thrust element has a cross-sectional area between 30% and 80% of the cross-sectional area of the hose.

9. The supply device according to claim 1, wherein the drive means comprises an electric, pneumatic or hydraulic actuator.

10. The supply device according to claim 1, wherein the drive means furthermore comprises two wheels, between which the thrust element is guided and of which at least one is driven.

11. The supply device according to claim 10, wherein
a. at least one of the two wheels has a knurling, an elastomer coating or an elastomer ring, or
b. one wheel is arranged in a preloaded manner in the direction of the other wheel.

12. The supply device according to claim 10, furthermore comprising at least one of the following sensors: a path sensor, a force sensor, a torque sensor or a speed sensor.

13. The supply device according to claim 1, wherein a length of the hose is at least 50 cm.

14. A setting tool for setting joining elements, wherein the setting tool comprises a supply device according to claim 1.

15. The setting tool according to claim 14, wherein the discharge portion is arranged adjacent to a setting head of the setting tool and the receiving portion is arranged remote from the setting head so that the joining element is dischargeable through the discharge portion to the setting tool.

16. A supply method using the supply device according to claim 1, comprising:
a. supplying a joining element to the receiving portion of the supply device,
b. positioning the joining element in front of the first opening in the receiving portion so that the joining element is arranged in front of the flexible thrust element,
c. moving the thrust element from a retracted state into an extended state, so that the joining element which is positioned in front of the thrust element is moved in the direction of the discharge portion through the hose, and
d. discharging the joining element when it reaches the discharge portion and moving back the flexible thrust element from the extended into the retracted position.

17. A setting method by using the supply device according to claim 1, wherein the thrust element comprises a transmission means adjacent to the front end which can be engaged with a head of the joining element so that a rotation of the thrust element can be transferred onto the joining element, the method comprising the steps:

a. supplying a joining element to the receiving portion of the supply device, b. positioning the joining element in front of the first opening in the receiving portion so that the joining element is arranged in front of the flexible thrust element, c. moving the thrust element from a retracted state into an extended state so that the joining element which is positioned in front of the thrust element is moved in the direction of the discharge portion through the hose, and d. applying a torque on the joining element by means of the transmission means at the front end of the thrust element by means of a second drive means when reaching the discharge portion and thus setting the joining element into at least one component with the thrust element.

* * * * *